US007044045B2

(12) United States Patent
Ettmüller et al.

(10) Patent No.: US 7,044,045 B2
(45) Date of Patent: May 16, 2006

(54) METHOD FOR PROGRAMMING THE SHATTERING OF PROJECTILES AND TUBE WEAPON WITH PROGRAMMING SYSTEM

(75) Inventors: Peter Ettmüller, Bachenbülach (CH); Klaus Münzel, Klingnau (CH)

(73) Assignee: Oerlikon Contraves Pyrotec AG, Zurich (CH)

( * ) Notice: Subject to any disclaimer, the term of this patent is extended or adjusted under 35 U.S.C. 154(b) by 221 days.

(21) Appl. No.: 10/785,910

(22) Filed: Feb. 24, 2004

(65) Prior Publication Data

US 2005/0126380 A1 Jun. 16, 2005

(30) Foreign Application Priority Data

Feb. 26, 2003 (CH) ..... 2003 02/03

(51) Int. Cl.
*F42C 17/04* (2006.01)

(52) U.S. Cl. ..... 89/6.5

(58) Field of Classification Search ..... 89/6, 89/6.5

See application file for complete search history.

(56) References Cited

U.S. PATENT DOCUMENTS 4,267,776 A * 5/1981 Eickerman ..... 102/215
5,787,785 A * 8/1998 Muenzel et al. ..... 89/6.5
5,814,756 A 9/1998 Boss
5,834,675 A * 11/1998 Boss ..... 89/6.5
5,894,102 A 4/1999 Oberlin et al.
6,216,595 B1 * 4/2001 Lamorlette et al. ..... 102/270
2002/0088367 A1 7/2002 MacAleese

* cited by examiner

*Primary Examiner*—Stephen M. Johnson
(74) *Attorney, Agent, or Firm*—McCormick, Paulding & Huber LLP

(57) ABSTRACT

A method for programming the shattering of projectiles (G) and a weapon (12) with a programming system (14, 16, 18). The projectiles are intended to destroy a target (Z) at which they are fired along heavily curved trajectories and are detonated at shattering points near the target. The longitudinal distance ($x_Z$) of the target from the weapon is measured and the elevation ($\lambda$) is adjusted for which a known muzzle velocity ($v_0(\mathbf{0})$) and a longitudinal distance of the shattering point at a predetermined optimal height ($y^*$) are taken into consideration. The actual muzzle velocity ($v_0$(eff)) is determined and a calculation for the programming is carried out in which the actual muzzle velocity is taken into account and the optimal height of the shattering point is held constant. The corresponding programming is transmitted to the projectiles. The weapon has an associated programming system for correspondingly programming the projectiles. The programming system has $v_0$-measuring means (14) for determining the actual muzzle velocity, and computer means (16) for calculating the programming of the projectiles, as well as transmitting means for transmitting the programming to the projectiles.

10 Claims, 3 Drawing Sheets

METHOD FOR PROGRAMMING THE SHATTERING OF PROJECTILES AND TUBE WEAPON WITH PROGRAMMING SYSTEM

BACKGROUND OF THE INVENTION

The present invention concerns a method for programming the shattering of projectiles at a shattering point in the neighborhood of a target, and a tube weapon with a programming system carrying out the shattering program. The priority of Swiss Patent Application No. 2003 0298/03 of Feb. 26, 2003 is claimed and the Application is incorporated herein.

In connection with the invention the term tube weapon is to be understood to include such tube weapons which are suited to the launching of projectiles, especially grenades, whose trajectories are strongly curved and which preferably lie in the lower angle group. The angles of descent of the projectiles which are launched by such tube weapons in the context of the invention lie in a range which is larger than about 5°. Such tube weapons are used in general for destruction of land and sea targets.

To obtain a maximum weapon effect with a shatterable projectile, the shattering of the projectile must take place in the nearby space surrounding the target to be destroyed. So that this happens, projectiles with programmable ignition are used, which in general are referred to as programmable or fuse settable projectiles. The goal of the programming is to achieve with similar projectiles, which are launched with similar elevations and which thereby fly along basically the same trajectory, detonation at different shattering points according to the position of the target with respect to the tube weapon.

Customarily in the programming the projectiles are not so directly programmed that they detonate at a given shattering point. More often the time of the shattering or the flight duration of the projectile between the weapon and the shattering point is programmed. For this either the flight duration can be directly programmed, or the number of projectile rotations up to detonation is pre-set.

So that the projectile develops an optimal effect several conditions in regard to the shattering point must be observed. The shattering of the projectile should take place at an optimal distance in reference to the target. The basis of this is the following: in the shattering or detonation of such projectiles numerous fragments or splinters are formed. These splinters in general have only a small mass but a high initial speed. Of course this speed diminishes rapidly because of air resistance. The splinters move outwardly from the detonation point, into a splinter space, which for example can be referred to as a scatter cone. The effectiveness of the splinters is essentially a function of their mass, their materials, and their shape as well their speed at the target. This effect diminishes with diminishing speed, or in other words, with increasing distance from the shattering point. The spatial effective region of such grenades or projectiles with explosive material is accordingly narrowly limited. For determining the optimal point for shattering the grenades into splinters two important conditions are therefore to be taken into account: first the shattering should take place as close as possible to the target, to develop a high effect on the target; in the case of earth and sea targets this means that the grenades must be detonated in the field surrounding the target. To achieve a good striking likelihood for the splinters the shattering must take place at a not too small distance from to the target. The flight time up to the shattering must absolutely be determined so that the shattering occurs before the impact. The mentioned conditions set narrow boundaries for the optimal region of the shattering point and especially for the height range of the shattering point.

Cannons are generally used for the destruction of targets with elongated shots. The trajectories of the projectiles launched in this way are therefore elongated or only slightly elevated and exhibit therefore overall only a small elevation above the ground relative to the attacked target. These projectiles are customarily so programmed that they are detonated at a certain longitudinal distance from the weapon. Because of the elongated flight paths in this case the projectiles detonate at low heights above the target.

Other tube weapons, especially tube weapons in the style of grenade launchers, shoot projectiles or grenades along trajectories which are more strongly elevated or curved than the trajectories of the above-mentioned cannon projectiles. In the case of these projectiles the programming takes place in the same way as with cannon projectiles, so that the programming takes into account the important requirement that the detonation point of a projectile should lie at a definite, small as possible, height above the target.

Indeed different possibilities are known for allowing the projectiles to detonate at an optimal position with the corresponding programming of the projectile taking into account the actual muzzle velocity or the deviation of the actual muzzle velocity from a known muzzle velocity. U.S. Pat. No. 5,814,756 for example describes how the shattering time can be so corrected that the horizontal shattering distance in front of the target remains constant as much possible. Also, U.S. Pat. No. 5,894,102 describes a method for correcting the shattering time for the purpose of maintaining a constant shattering distance between the weapon and the shattering point. Another method for shattering a grenade at a given horizontal distance from the weapon is revealed by U.S. patent application 2002/088367, wherein however no measurement of the muzzle velocity and no programming of the projectile results, but the detonation is triggered by a radar signal. All three mentioned documents therefore describe methods by which detonation of a projectile takes place at a predetermined horizontal distance.

Obviously the disadvantage of using the customary programming method originally designed for the elongated shooting of projectiles, which are shot along heavily curved trajectories, lies in that these projectiles because of their elevated trajectories are not detonated over the target at the optimal height and thereby have no satisfactory effect.

Moreover, in actuality the detonation of the projectiles does not occur at all, or only by chance, at those exact points at which they are supposed to take place according to the programming, since, as already mentioned, for different reasons always a certain scattering occurs. An essential ground for the scattering lies in that the actual muzzle velocities of the projectiles deviate from the theoretically calculated muzzle velocity of the projectiles, with however the programming being made on the basis of the theoretical muzzle velocity.

Summary of the Invention

It is now the object of the invention,

- to provide a method by means of which the effectiveness of projectiles, the trajectories of which are not elongated, is improved even if a deviation of the actual muzzle velocity of the projectile from the theoretical muzzle velocity is present;
- and to propose a tube weapon with a programming system which is suited to the carrying out of the method.

The solution to this object in accordance with the invention occurs for a method; and for a tube weapon with a programming system.

In the method, a shattering point in the vicinity of the target is determined by the distance to the target, the adjustment of the tube elevation in accordance with the predetermined muzzle velocity, and an optimal height of the shattering point above the target. The actual muzzle velocity is then determined and a calculation for the programming is carried out taking into consideration the actual muzzle velocity and the optimal height of the shattering point above the target. The programming is then transmitted to the projectile. The tube weapon includes a programming system carrying out the method.

The new method is especially, but not exclusively, used for tube weapons, hereinafter designated as weapons, which are shot in the lower angle group. The projectiles are programmed by the transmission of programming or a corresponding signal. The calculations for the programming take place with reference to the position of the target, launch and terminal ballistic criteria, a predetermined muzzle velocity, an actual or measured muzzle velocity of at least one of the projectiles, and the boundary condition that the detonation should occur at a shattering point which lies at an optimal height above the target.

In a pre-calculation the predetermined theoretical muzzle velocity is used. In a definitive calculation two thoughts are combined, namely the taking into account of the actual muzzle velocity, which is determined by a measurement, and the maintenance of the optimum height of the shattering point.

In this, the precalculation can be carried out before the measurement of the actual muzzle velocity, and after the measurement of the actual muzzle velocity a calculation correction, and with it the ultimate calculation, can be carried out; or the entire ultimate calculation can take place after the determination of the actual muzzle velocity.

With the new method one achieves the shattering of projectiles, such as grenades which are shot along strongly curved trajectories, at an optimal height over the target. The otherwise usual scattering, caused by the deviation of the actual muzzle velocity from the predetermined muzzle velocity, is practicality avoided by taking into consideration the actual or measured muzzle velocity. Taking into account the actual or measured muzzle velocity for optimizing the height of the detonation location is new, since customarily by taking into consideration the actual or measured muzzle velocity, the shot length, that is, the longitudinal distance of the detonation place from the weapon, was optimized.

The new method and the new programming system are, as already mentioned several times, intended especially for tube weapons, for example infantry weapons or machine cannons, which are suited for the shooting of projectiles along strongly curved trajectories and preferably in the lower angle group, wherein the descent angle relative to the horizontal exceeds about 5°.

Generally tube weapons used within the framework of the invention are those which are at least semi-automatic or automatic tube weapons, especially grenade launchers or machine cannons. The programming according to the method of the invention can however, also be carried out for projectiles fired as individual shots.

For the carrying out of the method, a tube weapon with a programming system is used. That programming system has according to the invention $v_0$-measuring means, computing means including memory means for the processing of data for the programming, and transmission means for the transmission of the programming or corresponding signals to the projectiles.

Preferably integrated distance measuring means are provided for measuring the longitudinal distance of the target from the tube weapon. For this however an external distance measuring means can also be used, and in certain cases the mentioned longitudinal distance can also be determined with the help of topographical maps.

The construction of the tube weapon with the programming system is preferably such that the delivery of projectiles is blocked if, as a result of the computations for the programming, a shattering point results which lies within a safety field around the tube weapon. The safety field is essentially dependent on the projectiles or their effective area.

Tube weapons for the delivery of projectiles in serial fire and with the new programming system are preferably so constructed that a serial firing or a firing burst is initiated by a shooter and is continued until an interruption is caused by the shooter.

It is advantageous if upon an interruption of serial fire certain settings are maintained, especially, in case the same target is again to be destroyed, the settings associated with the longitudinal distance of the target. A further serial firing or a further firing burst for destroying the same target can then take place without further input, and only upon the destruction of a new target must the associated settings be changed. The tube weapon can however also be so constructed that at the end of a serial firing or firing burst the used set values are cancelled.

BRIEF DESCRIPTION OF THE DRAWINGS

In the following the invention is described in detail by way of examples and with reference to the drawings. The drawings are not to scale. They show.

DETAILED DESCRIPTION OF THE PREFERRED EMBODIMENTS

First of all different terms, known in themselves, which appear in the following text or in FIGS. 1–4, will be explained.

Input specific magnitudes are: a destruction distance or a longitudinal distance $x_Z$ of a target Z, a longitudinal distance $x_Q$* of a shattering point Q, and an optimal longitudinal distance $x_Q$* of an optimal shattering point Q* from a tube weapon 12; and further tz, that is, the fused duration time, which begins to run with the ignition of the projectile G and at the end of which the shattering of the projectile G takes place at the shattering point Q. The working coordinates are designated by x and y.

Further influential magnitudes, for each of the known types of projectiles G, are: first, the effective distance w of a grenade G; which is a function of the grenade type and which over the destruction distance x or a region of the longitudinal distance is practicality constant; second, the error distance u; third, the height y or the elevation in the y-direction of the detonation point Q for a given target Z; and fourth, the fault allowance system E.

Still other influential values are a known or normal muzzle velocity $v_0(\mathbf{0})$ of the projectile G and an actual muzzle velocity $v_0$(eff) of the projectile G. For a precalculation the predetermined or predetermined or normal muzzle velocity $v_0(\mathbf{0})$ is used, and it is established that the shattering is to take place at the time t, which can be calculated from the different influential values. The effective muzzle velocity $V_0$(eff) differs in general from the predetermined muzzle velocity $v_0(\mathbf{0})$ and therefore must be measured. For the ultimate calculation the effective muzzle velocity $V_O$(eff) is taken into consideration. If a calculation is made with only the predetermined muzzle velocity $v_0(\mathbf{0})$, the shattering of the projectile G is based on an imparted signal after a flight duration t. If the ultimate calculation is made with the actual muzzle velocity $v_0$(eff), the signal imparted to the projectile G, and which determines the flight time to the shattering, must be so changed so that the shattering or detonation takes place after the flight duration t+Δt. Δt is a time error and can be either a positive or negative value. Δt should be as small as possible.

The elevation λ of the weapon tube 13 of the tube weapon 12 is set before the firing of the projectile G; and it allows the solution of known fundamental ballistic equations, from which the flight duration is determined.

Figure 1:
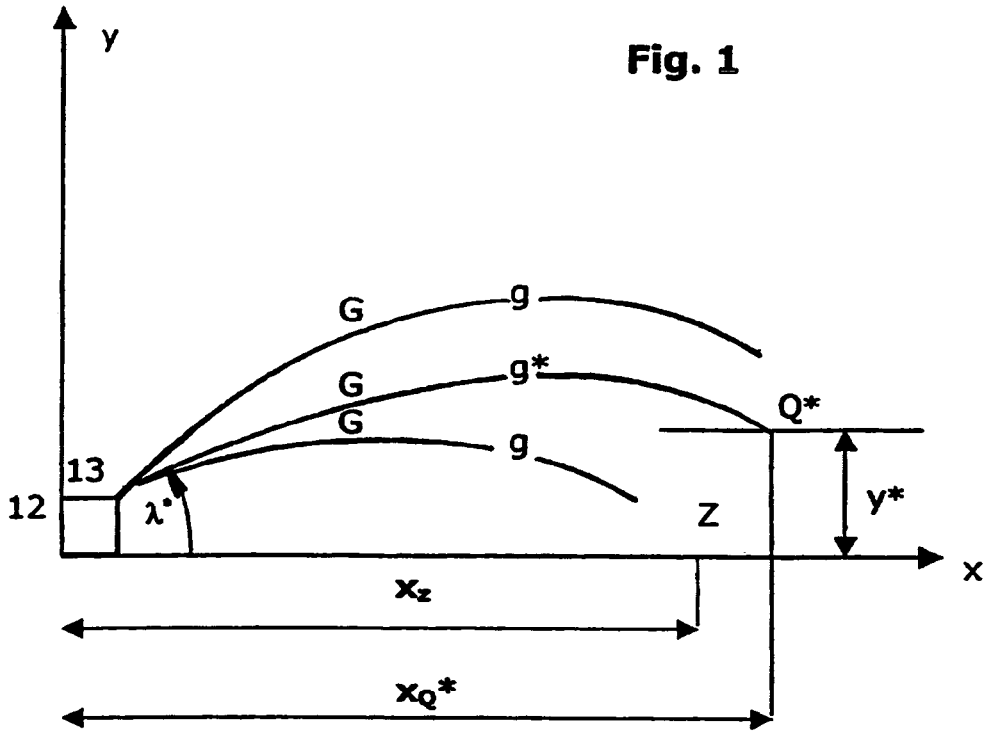
FIG. 1 the flight behavior of shatterable projectiles for explaining terms used in the framework of the description.

FIG. 1 shows the tube weapon 12 with a weapon tube 13 and a target Z to be destroyed at a longitudinal distance $x_Z$ from the tube weapon 12. The projectile G, with which the target Z is to be destroyed, moves in dependence on the input elevation λ of the weapon tube 13 over different projectile trajectories g or g*. The suitable elevation λ* is that which the projectile G reaches on the optimal projectile trajectory g*, so that the projectile G upon its shattering at the longitudinal distance $x_Q$* from the tube weapon 12 is at an optimal height y* above the target Z. An optimal programming has the result that the projectile G at this optimal height y* detonates at an optimal shattering point Q*. With the shattering of a projectile G resulting fragments move away in all directions from the shattering point with relative fragment velocities. The absolute velocity of each fragment is composed of the fragment velocity and of the projectile velocity. The target Z is optimally located approximately in the middle of a surface in which the plane of the target Z and the splinter space, where the splinters of the projectile G detonated at Q* disburse, intersect one another.

Figure 2:
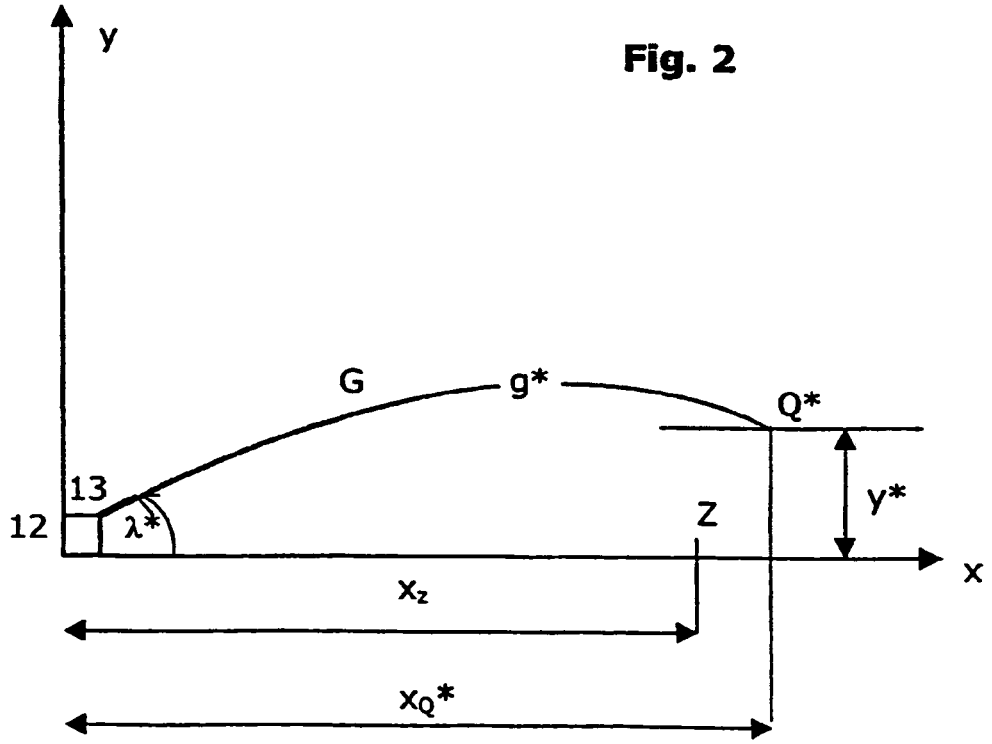
FIG. 2 a tubular weapon and a target to be destroyed, for explaining the determination of suitable settings, in schematic representation.

FIG. 2 illustrates the behavior of theoretically ballistically similarly acting projectiles G which are shot at the same elevation λ and with the same programming. The calculations for the programming in this case take into account only the predetermined muzzle velocity $v_0(\mathbf{0})$; a correction for taking into account the actual muzzle velocity $v_0$(eff) is not made. For clarity only three projectiles G are represented, but in actuality a series can contain far more than three projectiles. The tube weapon 12, which has the weapon tube 13, shoots the projectiles G to destroy the target Z by a preceding calculation, and with the given presumed elevation λ of the weapon tube 13 and taking into account a known lethality of the projectile G, the precalculation gives a flight time t up to the detonation. This precalculation takes place on the basis of the predetermined muzzle velocity $v_0(\mathbf{0})$. The shattering points Q of the projectiles G then theoretically lie at the optimal height y*; above the target Z to be destroyed and at a longitudinal distance $X_Q$* from the tube weapon 12, whereas in the previous case the shattering points Q lay somewhat closer to the tube weapon 12 than the target Z, which is situated at the distance $x_Z$ from the tube weapon 12.

Figure 3:
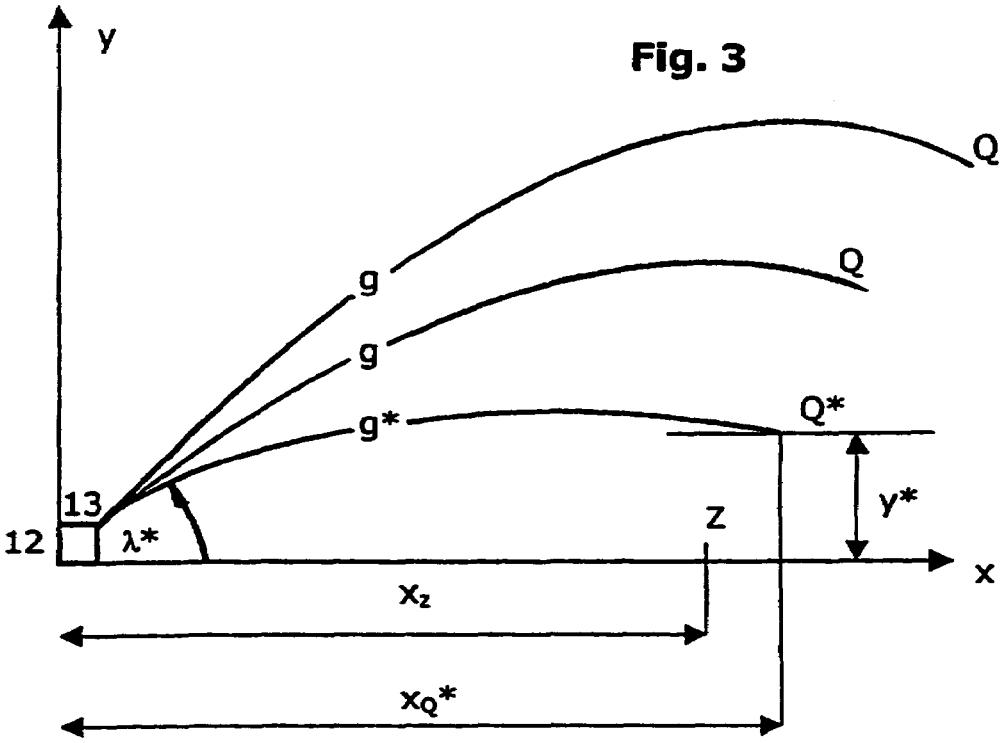
FIG. 3 a tube weapon and a target as well as flight paths of similar projectiles with similar programming, wherein only computation for preprogramming takes place but not for correction of the final programming in a representation similar to FIG. 2.

If the actual muzzle velocity $v_0$(eff) of the projectile G coincides with the predetermined muzzle velocity $v_0(\mathbf{0})$, then according to FIG. 3, assuming the absence of disturbing influences, all projectiles G move along a common optimal projectile projectory g* and detonate at the shattering point Q*. Generally and as often mentioned, the actual muzzle velocity of the projectile G deviates from the predetermined muzzle velocity $v_0(\mathbf{0})$ of the projectile G. This is the primary reason why the projectiles G, as illustrated in FIG. 3, even with shooting at the same elevation, move not on, or not only on, the optimal trajectory g* but on other trajectories g, and even with the same programming do not, or do not only, detonate at the optimum shattering point Q* but also at other shattering points Q.

Figure 4:
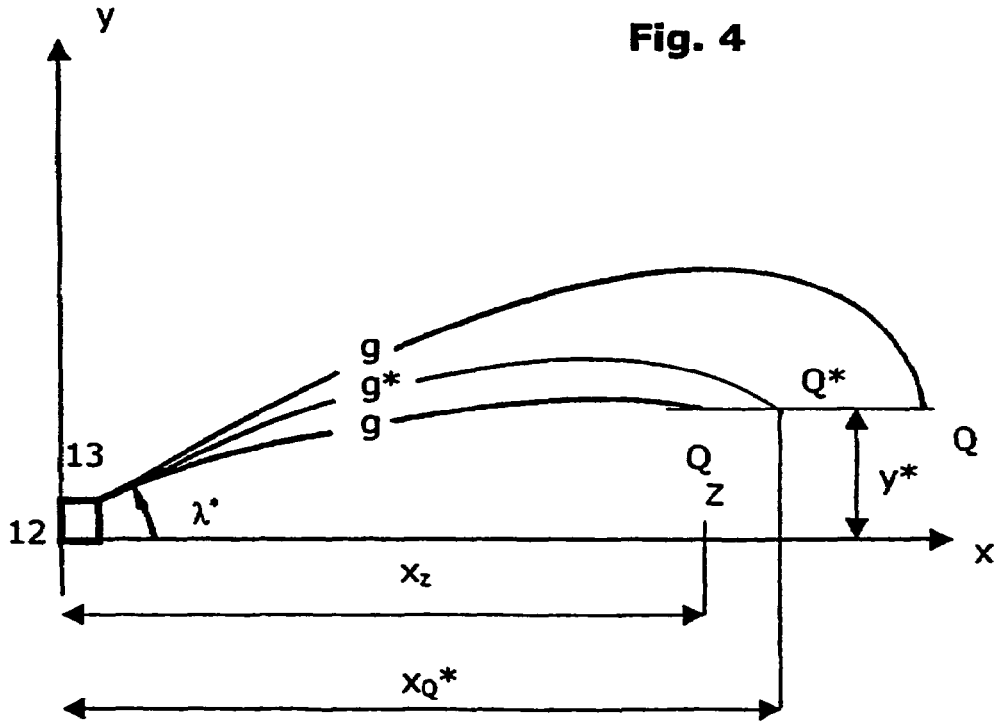
FIG. 4 a tube weapon and a target as well as flight paths of similar projectiles, wherein computation steps for precalculation and for definitive calculation take place, in a representation similar to that of FIGS. 2 and 3.
Figure 5:
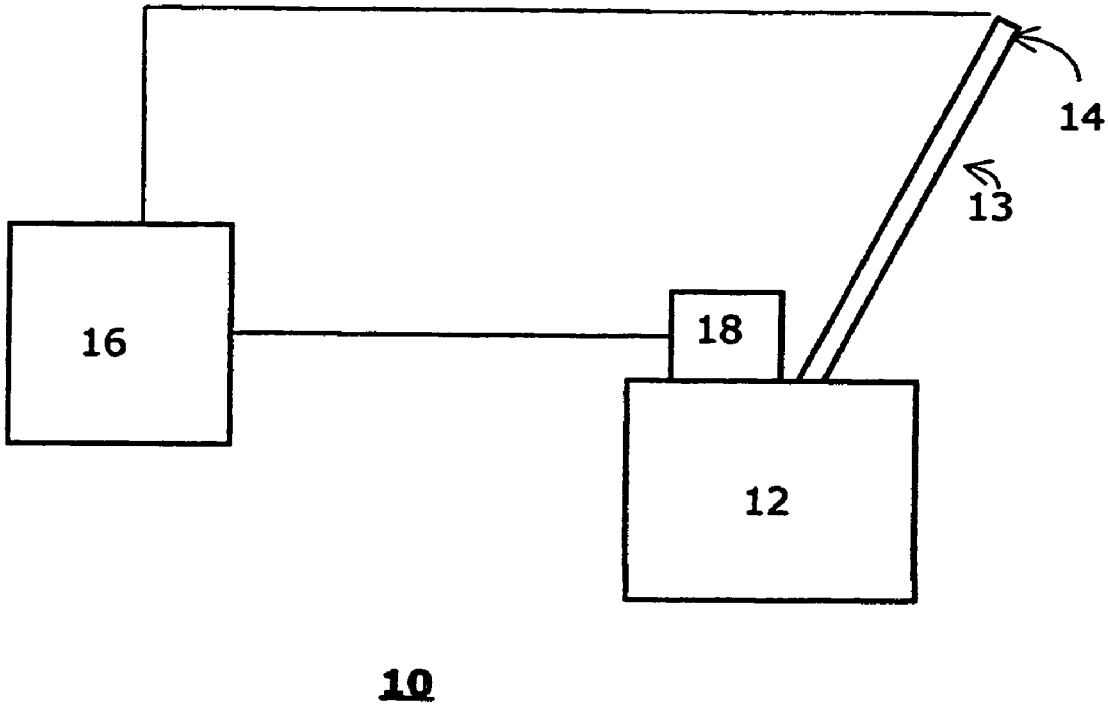
FIG. 5 a tube weapon with a programming system according to the invention, in schematic representation.

According to the invention the actual muzzle velocity $v_0$(eff) of at least one of the projectiles G is now measured. Taking into account the actual, measured muzzle velocity $v_0$(eff), or its deviation from the predetermined muzzle velocity $v_0(\mathbf{0})$, an ultimate calculation, or a computation correction, is obtained, and on the basis of the results of the ultimate computation, the programming for the projectiles is produced. The trajectories g, over which the projectiles G move, are the same as in FIG. 3, that is, the same as if the programming were carried out only on the basis of the precalculation without taking into account the actual muzzle velocity $v_0$(eff). But the ultimate calculation for the programming is such that the shattering points Q of all of the projectiles G lie at the optimum height y* of the optimum shattering point Q* above the target Z, as is illustrated in FIG. 4.

The advantage of the optimum height y* of all shattering points Q is above all a longitudinal deviation of the detonation point Q from $x_Q$* . If this longitudinal deviation is so large that the target Z is no longer efficiently destroyed by many of the projectiles G, another elevation λ will have to be chosen.

The middle value of the measured muzzle velocities of earlier or previously shot projectiles can be used as the predetermined muzzle velocity $v_0$(eff). To always obtain shattering points Q* with optimal heights y* about the target Z, a measurement of the effective muzzle velocity $v_0$(eff) should be carried out for each projectile G.

For carrying out the above-described method the tube weapon 12 is equipped with a programming system. Existing tube weapons, for example, infantry weapons such as grenade launchers or machine cannons, can, be modified as needed to include the new programming system, so that a destruction effect increase can be achieved.

The programming system has $v_0$-measuring means 14, computer means 16 and transmission means 18, for the transmission of calculated data from the computing means 16 to the projectiles G, including a transmission unit at the tube weapon 12. The $v_0$-measuring means 14 are generally arranged in the area of the muzzle of the weapon tube 13, before or after the muzzle section. The transmission means 18 are so constructed and arranged that the transmission of the data to the projectiles G takes place between a projectile loading point and the end of the weapon tube 13 before the launching of the projectiles.

As already mentioned, the ultimate calculation according to the new method has the result that the projectiles G are so programmed that they indeed detonate at the optimal height y* above the target Z, rather than at the optimal longitudinal distance $x_Q$* from the tube weapon. This problem has presented itself earlier in the destruction of surface targets, and as a solution it was then proposed that the shooting be done in a so-called chain of pearls mode. By this the following is to be understood: In the abstract similar projectiles are shot. These projectiles follow, apart from the usual inner and terminal ballistically occurring strays, in principle similar trajectories, which naturally then only coincide if the azimuth and elevation are not changed. These similar projectiles are now dissimilarly programmed, or the programs transmitted to them are dissimilarly calculated, so that from the launching to the shattering the first projectile has the longest flight duration and each successive projectile has a shorter flight duration. In this case, the characteristics of the projectories do not change, but the end points of the trajectories of the unshattered projectiles shift closer to the tube weapon with each successively fired projectile. By tuning the flight times of the projectiles to the cadence of the tube weapon, if wanted, a number of projectiles can be detonated simultaneously. Especially in the case of night time shooting this offers an observer a picture which at some distance can be compared to a chain of pearls, and from this is derived the term "chain of pearls mode". It should also be known that shooting in the pearl of chain mode does not necessarily mean that the projectiles detonate simultaneously.

If one combines the idea of programming projectiles G for point shooting mode according the invention, that is, the maintenance of the optimal height y* of the shattering point Q*, with the idea of the known chain of pearls mode, a very advantageous method can result from it. This makes possible the programming of projectiles for tube weapons by means of which point targets, that is, targets with known azimuth, can be efficiently destroyed with strongly curved trajectories and indeed even with a considerable longitudinal deviation of the detonation points. In this case, above all, for a major portion of the projectiles a certain height deviation from the optimal height y* of the shattering point Q must be taken as a cost involved.

Naturally with the chain of pearls mode an improvement can be achieved even if no consideration is given to the deviation of the effective and predetermined muzzle velocity, and accordingly if no $v_0$ measurement takes place and/or if the measurement or estimation of the longitudinal distance of the target from the weapon is performed inexactly.

A further problem which presents itself in connection with the shooting of programmable projectiles by tube weapons is the following: Tube weapons in the context of the invention are, as already mentioned, frequently used for the destruction of surface targets which are not accurately detectable from within the surface or are themselves movable targets. To achieve hits the entire surface must be covered with shots. This can in the point shooting mode, that is, with a number of similarly programmed projectiles, be achieved in that in the firing of a series of projectiles the weapon tube is pivoted in azimuth as well as in elevation. The weapon tubes of infantry weapons are mostly directed by muscle power and can changed in azimuth during the firing of a series of projectiles without anything further. A surface can thereby be covered in its breadth with fire in the point shooting mode by swinging the weapon tube in azimuth, with longitudinal straying being able to help cover the surface over a certain but limited length with fire. In this way surfaces which are seen in the shooting direction not as having large dimensions can be covered with fire in a satisfactory way.

Often, however, surfaces are to be covered with fire, which surfaces as seen in the shooting direction have relatively large dimensions. With the above-described point shooting mode, that is, with the firing of projectiles with similar programming, with or without calculation correction to take into account the actual muzzle velocity, indeed without anything further, such surfaces can be covered with fire in their width but not in their entire length.

It is therefore also here sought to use the above-described known method of the customary chain of pearls mode for tube weapons within the scope of the invention, for which weapons the term infantry tube weapons is used. Thereby, in firing on a surface target whose longitudinal range from the weapon is large, as seen in the shooting direction, a satisfactory weapon effect can be achieved by shooting in the point shooting mode. With projectiles, which in this customary chain of pearls mode are shot from infantry tube weapons and which therefore have a corresponding chain of pearls programming, the surrounding field of a target not accurately located or a surface target can be hit even if it is assumed that the elevation during the shooting is not changed. If the shots during the shooting also do not change in azimuth, then the impact surface consists of a strip of land lying in the shooting direction in front of the weapon. If the shots during the shooting change in azimuth,—and that is actually intended in the destruction of surface targets, then the impact surface consists however only of a strip of land lying diagonally in front of the weapon, in which strip the detonation points of the successively shot projectiles in step-wise fashion come nearer to the weapon.

This disadvantage can be removed by a method for shooting with infantry tube weapons in a modified chain of pearls mode. In this case the projectiles are so programmed that the detonation points of the individual projectiles change in a step-wise fashion, and indeed not only in one direction, that is, with steadily shortened shattering times, but instead a first group of projectiles of a series are programmed with progressively shortening shattering times, a second group are programmed with progressively lengthening shattering times, and this is continued with each group being oppositely programmed in comparison to the proceeding group. The division of projectiles into groups is fictional and serves only as a perceived description of the new method. The projectiles of the different groups differ from one another, as already mentioned, not in their construction but only in their programming.

Customarily the projectiles are so programmed that the flight durations of the projectiles of the first group steadily diminish and the flight durations of the projectiles of the second group steadily increase.

The number of projectiles in each group can be predetermined or can be set from case-to-case or from use-to-use.

A group whose projectiles detonate with diminishing distance from the weapon is in principle ended when the predetermined or fixed number of projectiles have been shot. Advantageously, however, an interlock is provided for the purpose of ending a group before the detonation point of a projectile falls outside a safety distance from the weapon.

The second group of projectiles generally is followed by further groups with the projectiles of each successive group being oppositely programmed.

During the cut off of each group by the programming, or as the case may be by the maintaining of the safety distance if necessary, it is advantageous if the cut off of the entire firing burst is not the result of a given duration, or is not according to a number of discharged projectiles, but instead the result of a determination by shooter himself to end the final burst. In this manner the shooter is not surprised by a sudden ending of the burst.

The programming can be so constructed that a reprogramming from progressively closer detonation points to progressively farther detonation points is coupled with a pivoting of the weapon about a given minimum angle.

The invention claimed is:

1. A method for programming the shattering of projectiles (G), which are intended for the destruction of a target (Z) and are to be shot from the tube (13) of a weapon (12) along a strongly curved trajectory (g, g*) to detonate at a shattering point (Q*) in the neighborhood of the target (Z), wherein a distance measurement for determining the longitudinal distance ($x_Z$) of the target (Z) from the weapon (12) is carried out, the tube (13) is adjusted to a suitable elevation (λ), taking into consideration a predetermined muzzle velocity ($v_0$(0)) of the projectiles (G) and the longitudinal distance ($x_Z$) of the target (Z) from the weapon (12) as well as maintaining an optimal height (y*) of the shattering point (Q*) above the target (Z)

an actual muzzle velocity ($v_0$(eff)) of the projectiles (G) is determined, a calculation for the programming is carried out taking into consideration the actual muzzle velocity ($v_0$(eff)) and under the condition of maintaining the optimal height (y*) of the shattering point (Q*) above the target (Z), and the programming is transmitted to the involved projectiles (G).

2. A method according to claim 1, wherein for the calculation of the programming of the projectile (G) is carried out by a preliminary calculation taking into consideration the predetermined muzzle velocity ($v_0$(0)) and an ultimate calculation taking into account the actual muzzle velocity ($v_0$(eff)).

3. A method according to claim 1, wherein the projectiles (G) have a descent angle relative to the horizontal which exceeds the range of 5°.

4. A method according to claim 1, wherein the flight paths (g, g*) of the projectiles (G) lie in the lower angle group.

5. A method according to claim 1 wherein the projectiles (G) are shot individually or in series.

6. A weapon (12) with a tube (13) for the shooting of projectiles (G) along heavily curved trajectories (g, g*) and with a programming system (14, 16, 18) for so programming the projectiles (G) that they detonate in flight at a shattering point (Q*) to destroy a target (Z) which is spaced from the weapon (12) by a longitudinal distance ($x_Z$), which programming system includes:

$v_0$ measuring means (14) for determining the actual muzzle velocity ($v_0$(eff)) of the projectiles (G), computer means (16) for calculating the programming of the projectiles (G)

taking into consideration a predetermined muzzle velocity ($v_0$(0)) of the projectiles (G) and the longitudinal distance ($x_Z$) of the target (Z) from the weapon (12), and maintaining the optimal height (y*) of the shattering point (Q*) above the target (Z), and taking into consideration the measured muzzle velocity ($v_0$(eff)) of projectile (G), as well as transmission means (18) for transmitting the programming to the projectiles (G).

7. A weapon (12) with a programming system (14, 16, 18) according to claim 6, wherein the computer means (16) are constructed to, carry out a precalculation taking into the account the predetermined muzzle velocity ($v_0$(0)), carry out an ultimate calculation taking into account the actual muzzle velocity ($v_0$(eff)), and wherein the computer means (16) has associated storage means for storing the results of the precalculation up to the ultimate calculation.

8. A weapon (12) with a programming system (14, 16, 18) according to claim 6 wherein the projectiles (G) are so constructed and fireable that their descent angle relative to the horizontal exceeds the range of 5°.

9. A weapon (12) with a programming system (14, 16, 18) according to claim 6 wherein the projectiles (G) are fireable along trajectories (g, g*) which lie in the lower angle group.

10. A weapon (12) with a programming system (14, 16, 18) according to claim 6 wherein the weapon (12) is so constructed that the projectiles (G) are fireable individually or in series.

* * * * *